US006634073B1

(12) United States Patent
Adachi et al.

(10) Patent No.: US 6,634,073 B1
(45) Date of Patent: Oct. 21, 2003

(54) CONTINUOUS PRODUCTION FACILITIES FOR WIRE

(75) Inventors: Koji Adachi, Muroran (JP); Koji Tanabe, Muroran (JP); Ryuichi Seki, Muroran (JP); Kiichiro Tsuchida, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/744,370

(22) PCT Filed: May 24, 2000

(86) PCT No.: PCT/JP00/03317

§ 371 (c)(1),
(2), (4) Date: Jan. 23, 2001

(87) PCT Pub. No.: WO00/71274

PCT Pub. Date: Nov. 30, 2000

(30) Foreign Application Priority Data

May 31, 1999 (JP) ..... 11-152282
May 24, 1999 (JP) ..... 11-143156

(51) Int. Cl.[7] ..... B23P 23/06; B21B 1/18; B21C 47/14; B22D 11/124

(52) U.S. Cl. ..... 29/33 C; 29/33 F; 266/106; 266/259; 148/601; 148/602; 72/201; 72/235

(58) Field of Search ..... 266/106, 259, 266/103; 29/33 C, 33 F, 33 Q, 33 S, 33 P, 564; 148/600, 601–602; 72/201, 235

(56) References Cited

U.S. PATENT DOCUMENTS 3,711,918 A * 1/1973 Shore ..... 266/106
4,242,153 A * 12/1980 Vitelli et al. ..... 29/33 F
4,546,957 A * 10/1985 Jalil et al. ..... 266/106
4,982,935 A * 1/1991 Nonini et al. ..... 266/106
5,050,418 A * 9/1991 Grotepass ..... 72/201
5,325,697 A * 7/1994 Shore et al. ..... 72/234
5,665,303 A * 9/1997 Hauck ..... 148/601

FOREIGN PATENT DOCUMENTS

| | | |
|---|---|---|
| EP | 0512735 | 11/1992 |
| EP | 0707082 | 4/1996 |
| JP | 60-55572 | 12/1985 |
| JP | 61-257417 | 11/1986 |
| JP | 4-37898 | 9/1992 |
| JP | 7-98977 | 10/1995 |
| JP | 8-193222 | 7/1996 |
| JP | 2857279 | 11/1998 |

OTHER PUBLICATIONS

Metals Handbook, Desk Edition, Second Edition, Edited by J.R. Davis, 1998, ASM International, pp. 194–202.*
Internet Printout from www.principalmetals.com/glossary/tdoc, printed Aug. 20, 2002, nine pages.*
Internet Printout from www.abana.org/resources/education/tempil_guide, printed Aug. 20, 2002, five pages.*

* cited by examiner

*Primary Examiner*—A. L. Wellington
*Assistant Examiner*—Erica E Cadugan
(74) *Attorney, Agent, or Firm*—Kenyon & Kenyon

(57) ABSTRACT

The present invention relates a train of in-line continuous manufacturing equipment for producing steel wire, considered difficult with a block mill up to now, capable of efficiently carrying out controlled-rolling and slow-cooling by an effective in-line combination of controlled rolling apparatuses and slow cooling apparatuses, having a hot rolling mill for steel wire, a winder to wind the rolled steel wire into rings, bundling apparatuses to pack the wound steel wire into bundled coils and an in-line heat treatment furnace to slow-cool the steel wire bundled into coils, which are sequentially connected, and using, preferably, a block mill with an area reduction rate of 25 to 60% having at most 4 roll stands as a final finish rolling mill of the hot rolling mill.

2 Claims, 8 Drawing Sheets

CONTINUOUS PRODUCTION FACILITIES FOR WIRE

FIELD OF ART

The present invention relates to a train of equipment to continuously manufacture steel wire and, more specifically, to a train of equipment to continuously manufacture steel wire of carbon steel for machine structure use or alloy steel having an excellent cold working property.

The present invention relates to temperature controlling apparatuses for hot rolled steel wire and, in more detail, to temperature controlling apparatuses which are so designed that desired treatment patterns can be chosen, in one line, from among various kinds of cooling and heat retention treatments and heat treatments of wire in coils in accordance with the material quality and the final use of hot rolled steel wire.

BACKGROUND ART

A common process to manufacture steel wire comprises the steps of; heating a billet to a prescribed temperature in a reheating furnace, hot rolling the billet into wire of an intended size, winding the wire into continuous rings, cooling and appropriately heat-treating the wire, packing the wire into a bundled coil, and banding the coil. The bundled coil may undergo treatments such as annealing as required, before being shipped to a secondary work process. Various proposals have been made regarding the hot rolling and heat treatment steps of the steel wire manufacturing.

Looking at hot rolling of steel wire from the apparatus viewpoint, for example, a block mill, developed as a finish rolling mill for steel wire, has advantages especially of high speed rolling, compact equipment design and fewer surface defects. A block mill, in which 8 to 10 roll stands are closely arranged in tandem in one frame, can roll a material without twisting it and, for this reason, it has been introduced in many rolling lines recently.

Looking at the hot rolling of steel wire from the viewpoint of material property and structure, it is possible to refine a γ structure by employing a method to hot-roll at as low a temperature as possible, for example not exceeding 800° C., and make the rolling finishing temperature lower than that in normal rolling practices (such a rolling method being hereunder referred to as controlled rolling). A technology has been known to soften the material of steel wire by dividing and granulating a laminated cementite of a pearlite structure through a combination of the above rolling method with slow cooling in the downstream process steps. However, since the rolling finishing temperature is usually 900° C. or higher in the normal practice of steel wire rolling, the refinement of γ structure cannot be achieved, and it is necessary to anneal steel wire off-line to soften the wire material.

Japanese Patent No. 2857279 discusses a conventional example of using a rolling mill resembling the one employed in the present invention. FIGS. 1 and 2 of the patent show an equipment configuration where a 4-stand post-finishing block mill is provided after an 8-stand finishing block mill to realize free-size rolling and precision rolling. In addition, the patent also proposes to provide a cooling apparatus at the entry side of the post-finishing block mill.

In the meantime, various methods have been proposed such as the one to wind and spread hot rolled steel wire into non-concentric rings and subject it to a direct heat treatment in the process of packing it into a bundled coil. The Stelmore method is an example of such proposals. Among these proposals, a means disclosed in Japanese Examined Utility Model Publication No. H4-37898 to construct a winder (laying cone), a transportation route for the wire in continuous rings and a heat retention furnace covered with a closed heat retention cover, and a technology disclosed in Japanese Examined Patent Publication No. H7-98977 to provide a line for normal heat treatment and another line for slow cooling, in a manner to allow switching, and to feed steel wire to a conveyer of a selected succeeding process, can be counted as conventional examples to treat steel wire in the form of bundled coils for the purpose of slow cooling after the winding.

With a finishing mill such as the block mill mentioned above, however, the total area reduction rate through 8 stands is as high as about 85%, and controlled rolling is practically impossible with hard materials generating large amounts of heat during working and used mainly for machine structure, such as carbon steels with 0.4% or more of carbon, alloy steels, spring steels and bearing steels. Further, in the Japanese Patent No. 2857279 mentioned above, a 4-stand block mill is installed as a finish rolling mill and a cooling apparatus is provided at the entry side of the mill. This arrangement, however, aims at suppression of abnormal growth of crystal grains and not at on-line manufacturing of soft steel wire having an excellent cold working property through a combination of grain size refinement by controlled rolling with a cooling means in a succeeding process, which is the feature of the present invention.

In the above-mentioned Japanese Examined Utility Model Publication No. H4-37898, a unique structure is employed where a winder is covered with a closed cover and, for this reason, there is a problem in terms of equipment costs, since a special apparatus is required exclusively from winding to slow cooling and thus most of existing wire manufacturing facilities cannot be used. Further, according to the above-mentioned Japanese Examined Patent Publication No. H7-98977, since pot type furnaces are employed for slow cooling of bundled coils, there are problems of difficulty in individually controlling the temperature, low productivity and the process not being suitable for continuous operation. In addition, since slow cooling starts in these conventional slow cooling lines from a comparatively high temperature of 850° C. or higher, there is a drawback that the line length inevitably tends to be long.

Besides the above, various methods of controlled cooling of steel wire are practiced during transfer on a conveyer after hot rolling, winding into rings using a winder having a laying head and spreading onto the conveyer. These methods include cooling by air blast, leaving to cool naturally (these two methods being hereunder simply referred to as, respectively, blast cooling and natural cooling), rapid-cooling actively with water or, otherwise, cooling slowly or retaining heat by covering a transfer line with a heat retention cover.

For example, Japanese Examined Patent Publication No. S60-55572 discloses a technology whereby hot rolled steel wire laid on a conveyer in rings is cooled with an air blast or a water spray and then, after being packed into bundled coils on pallets, is charged by a branching conveyer into an annealing furnace for a continuous heat treatment. Cooling with a water spray has a shortcoming in that it is incapable of cooling evenly and the wire material becomes inhomogeneous. What is more, this technology inevitably requires very large equipment occupying a huge area, resulting in a big disadvantage in the plant space requirement. The same publication discloses also a water cooling method used after forming the wire into bundled coils, but this method results in a highly inhomogeneous cooling.

Also, Japanese Unexamined Patent Publication No. H6-336620 discloses a technology whereby hot rolled steel wire laid on a conveyer in rings is rapid-cooled by directly submerging it into a cooling tank, then, after being packed into bundled coils, heat-treated (quenched and tempered) in a tempering furnace. This technology, however, employs a method to heat the bundled coils suspended on a hook conveyer. Since a maximum furnace atmosphere temperature in this method of transportation cannot surpass 650° C. or so as the bundled coils deform at a temperature exceeding 650° C., the method has a problem in that it is inapplicable to a quick heat treatment at high temperatures.

Further, Japanese Unexamined Patent Publication No. H8-193222 proposes apparatuses to selectively supply hot rolled wire to different lines for different kinds of heat treatment. According to the technology disclosed therein, in transferring steel wire wound into rings on a conveyer, heat-treating it and packing it into bundled coils on the conveyer, the wire is first packed into bundled coils after winding and is then transferred to a separate line for cooling in an immersion type cooling apparatus or, otherwise, bundled coils of wire are covered individually with heat-insulating hoods and gathered in a covered pit for heating, and processing lines for these and other heat treatments are arranged so that each of them may be selected as required. In this technology, however, the various heat treatment lines are arranged on a same plane and, for this reason, operability is poor due to an entangled layout of the lines and the disadvantage, in terms of required space, is great. Moreover, steel wire in coil cannot be cooled evenly because, when a bundled coil is immersed into water, water does not infiltrate into the interior.

As can be seen from the above, among past technologies related to rolling and heat treatment of steel wire, no example where controlled rolling and slow cooling are considered in combination with each other can be found.

From the above, therefore, materialization of an economical train of equipment to continuously manufacture steel wire of carbon steel for machine structure use or alloy steel having an excellent cold working property, wherein a controlled rolling means using a block mill and slow cooling means are rationally combined in one continuous line and high level operation both of the rolling and slow cooling can be achieved, and the train of equipment can be easily incorporated into an existing line, is strongly desired.

DISCLOSURE OF THE INVENTION

An object of the present invention, which was completed in view of the above situation, is to provide a train of equipment, to manufacture steel wire, capable of easily realizing controlled rolling (low temperature rolling), which has been conventionally regarded as being difficult with a block mill, and efficiently performing the controlled rolling and slow cooling through an effective in-line combination of a controlled rolling apparatus with slow cooling apparatuses. Another object of the present invention is to provide a train of equipment, to manufacture steel wire, capable of manufacturing every size of steel wire while eliminating annealing processes, which have been considered indispensable in secondary working stages which requires as short a line as possible for slow cooling.

A further object of the present invention is to remarkably expand the degree of freedom in in-line treatment of hot rolled steel wire by continuously combining a controlled cooling section, for steel wire in rings, covering a wide range of cooling methods from water cooling to slow cooling with a heat treatment section for the wire in coils as well as to make the space required for equipment as small as possible by vertically and rationally arranging a controlled cooling zone, including an immersion cooling means, and by providing a common conditioning and banding line for coils paid off from each of the treatment lines.

A train of equipment to continuously manufacture steel wire according to the present invention for achieving the above objects is characterized by sequentially connecting a hot rolling mill, to roll billets of carbon steel for machine structure use or alloy steel to a desired diameter, a winder to wind and form the rolled steel wire into rings, bundling apparatuses to pack the wire in rings into bundled coils and an in-line heat treatment furnace to slow-cool the wire packed into bundled coils, and by using a block mill having at most 4 roll stands as a final finishing mill of said hot rolling mill. In this configuration, the restriction of the area reduction rate of the final finishing block mill to a range of 25 to 60% and the design of the mill to have at most 4 roll stands prevent the generation of excessive working heat and make the envisaged controlled rolling possible.

The train of equipment to continuously manufacture steel wire according to the present invention is characterized, besides the above, in that an in-line heat treatment furnace has a capacity to accommodate ¼ to all of the number of bundled coils of wire rolled in 1 hr. at the maximum rolling capability. Even with this capacity, the heat treatment furnace can cool the wire at a very mild cooling rate of 0.1° C./sec., or slower, and slow enough to cause division and granulation of laminated cementite of pearlite structure and thus the slow cooling line does not need to be very long.

Further, the train of equipment, to continuously manufacture steel wire, according to the present invention is characterized, besides the above, by having, between a winder and bundling apparatuses, a controlled cooling and transporting apparatus equipped with heat retention covers to transfer steel wire, formed into continuous non-concentric rings, while holding it without lowering the temperature. The train of equipment is characterized also by winding steel wire using a winder at a temperature not below the $Ar_1$ transformation point, transporting the wound wire without lowering the temperature below the $Ar_1$ transformation point in a controlled cooling and transporting apparatus having heat retention covers and feeding the wire to bundling apparatuses and a slow cooling line. With the holding and transportation apparatus, it is possible to feed the steel wire in rings always in a stable condition to the slow cooling line without involving a special winding apparatus such as a one covered with a closed cover. The apparatus also makes it possible to apply the present invention to an existing manufacturing line easily and economically even when there is a restriction in the layout such that the distance between its winder and bundling apparatus is too long. In addition, the apparatus also has a function to homogenize the temperature of steel wire as well as to control the wire temperature to the commencement temperature of the succeeding slow cooling process by properly controlling the atmosphere temperature inside the apparatus when transferring the wire inside the heat retention covers.

Additionally, the train of equipment to continuously manufacture steel wire according to the present invention is characterized, further to the above, by having, at the entry side of a final finishing mill, a water cooling and recuperation zone having a length equal to or longer than 1/10 of the distance traveled by the steel wire in 1 sec. at the maximum rolling-speed. The water cooling and recuperation zone-makes controlled rolling possible by supplying the final finishing block mill with the desired steel wire without causing material deterioration.

The train of equipment to continuously manufacture steel wire according to the present invention is further characterized by packing steel wire, bundled in bundling apparatuses, into tight coils by the use of stems. inserted into the inner space of the coils and transporting the coils to a succeeding in-line heat treatment furnace. Feeding the steel wire coils tightly packed, rather than loosely, to the heat treatment furnace prevents a slow cooling line from becoming too lengthy, makes the mild cooling effective and secures stability during the transportation.

The train of equipment to continuously manufacture steel wire according to the present invention is further characterized, in terms of specific equipment configuration: by having;

No. 1 controlled cooling zone easily and selectively convertible into any of a water cooling line, a blast cooling and natural cooling line and a slow cooling and heat retention line at the exit side of the winder to wind the hot-rolled steel wire into rings using a laying head, No. 2 controlled cooling zone easily and selectively convertible into any of a blast cooling and natural cooling line and a slow cooling and heat retention line, succeeding said No. 1 controlled cooling zone, a transfer means to transfer the steel wire in rings between the Nos. 1 and 2 controlled cooling zones and No. 1 bundling apparatus to pack the steel wire rings into bundled coils in a manner that each of them can be alternatively placed at a boundary position between Nos. 1 and 2 controlled cooling zones, No. 2 bundling apparatus at the rear of said No. 2 controlled cooling zone, and a heat treatment means to slow-cool or heat the bundled coils of steel wire packed by said No. 1 bundling means connected to the position where said No. 1 bundling means is installed: and by selectively using the controlled cooling zones and/or the heat treatment means in accordance with the temperature pattern required for obtaining desired material properties of the steel wire.

The above configuration, in which the controlled cooling section of the wire in rings is divided into Nos. 1 and 2 controlled cooling zones, No. 1 controlled cooling zone has the functions of 3 selectable lines, namely a water cooling line, a blast and natural cooling line and a slow cooling and heat retention line, the No. 2 controlled cooling zone has the functions of 2 selectable lines, namely a blast and natural cooling line and a slow cooling and heat retention line, both the retractable transfer means and the No. 1 bundling means to pack the wire rings into bundled coils are provided at the boundary between Nos. 1 and 2 controlled cooling zones, and No. 1 bundling means is connected with the heat treatment furnace, makes it possible to carry out on-line, in addition to ordinary blast cooling and natural cooling of the steel wire in rings, treatments conventionally carried out off-line such as heating of packed wire coils after a water cooling (immersion cooling) of the wire in rings, holding bundled coils after blast cooling or natural cooling of the wire in rings, and slow cooling of bundled coils after slow cooling and heat retention of the wire in rings.

The train of equipment for continuously manufacturing steel wire according to the present invention is further characterized in that a temperature controlling apparatus for steel wire after winding has, as a water cooling means of No. 1 controlled cooling zone, a cooling tank to directly immerse steel wire and a capability to use either cold water or hot water alternatively. It is preferable to install the immersion cooling tank beneath the transportation line for the blast and natural cooling and slow cooling and heat retention to make the equipment arrangement space-efficient.

Further, above-mentioned temperature controlling apparatuses are characterized by employing heat retention covers or heat retention covers with heat sources as slow cooling means in Nos. 1 and 2 controlled cooling zones. The heat retention covers secure a very low cooling rate of the steel wire in rings passing through them and are useful for efficient utilization of rolling heat. The steel wire may be actively heated by the heat sources when required. The temperature controlling apparatuses are further characterized by their continuous arrangement at the rear of a steel wire rolling line having, as a finishing rolling mill, a high rigidity block mill with a mill rigidity of at least 40 ton/mm or more. The manufacturing equipment of the above arrangement rationally combines the controlled rolling apparatuses with the cooling apparatuses to efficiently manufacture steel wire having an excellent secondary working property.

Additionally, a heat treatment means for slow cooling or heating of the steel wire in bundled coils may be of a tunnel type to receive and transport the coils or of a pot type to cover each of them. Either of the types may be selected in consideration of factors such as ease of operation, relationship with other facilities and cost efficiency.

In addition to the above, the train of equipment to continuously manufacture steel wire according to the present invention is characterized by transporting and supplying steel wire coils, coming from No. 2 bundling means and a heat treatment means, to a common conditioning and banding means. This arrangement realizes a rational and compact layout of the whole manufacturing line equipment, resulting in great advantages in the plant space and work efficiency.

BEST EMBODIMENT FOR CARRYING OUT THE INVENTION

The present inventors have accomplished this invention as a result of research and experiments aiming at inventing a train of steel wire manufacturing apparatuses having excellent productivity and practicability: capable of;

discharging steel wire at a temperature around 750° C. at the delivery from a finishing mill by enabling controlled rolling with a block mill, stably supplying wound rings of low temperature steel wire directly to the process steps after a winder, and to a slow cooling line in particular, and manufacturing steel wire having desired material properties by achieving a target cooling rate of 0.1° C./sec. or lower at the slow cooling line: and not requiring a large scale modification of an existing steel wire rolling line.

Some embodiments of the present invention are described hereafter by referring to attached figures.

Figure 1:
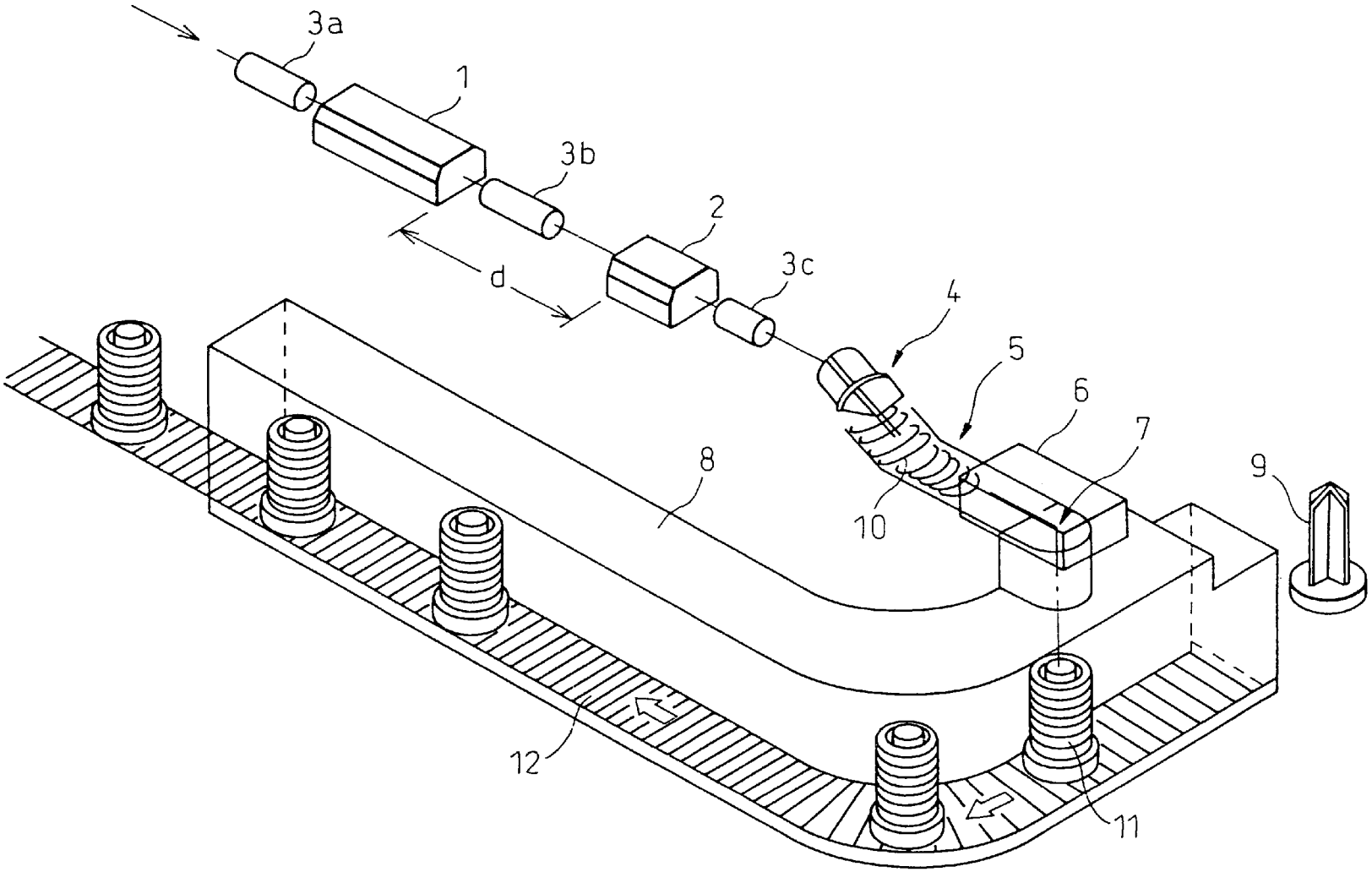
FIG. 1 is a general schematic perspective view showing an embodiment of a train of equipment to continuously manufacture steel wire according to the present invention.

FIG. 1 is a schematic view showing an example of a train of equipment to manufacture steel wire according to the present invention. In the figure, reference numeral 1 is a pre-finishing block mill, which is, for example, a mill of a known type comprising 8 to 10 roll stands having a total area reduction rate of 85% or more. Note that, before a water cooling zone 3*a* installed at the entry side of said pre-finishing block mill 1, although not shown in the figure, a reheating furnace to heat steel billets to be raw materials and roughing mill trains and intermediate mill trains to hot-roll the billets, heated to a prescribed temperature, into a desired size, are installed.

The following reference numerals in the figure indicate the following apparatuses, respectively: 2 a finishing block mill to reduce the sectional area of steel wire to a final size, installed at the delivery side of said pre-finishing block mill 1; 3*b* a water cooling zone provided at the entry side of the finishing block mill 2; 3*c* another water cooling zone provided at the exit side of the finishing block mill 2; 4 a winder to wind the hot rolled steel wire into rings of a prescribed diameter using a laying head; 5 a controlled cooling conveyer to spread the wound steel wire into non-concentric rings and transport it; 6 a heat retention cover covering the wire transportation route of said controlled cooling conveyer 5; and 7 a bundling apparatus to let steel wire in rings 10 transferred on the conveyer fall vertically and to form a bundled coil around a bundling stem 9 waiting underneath.

Further, reference numeral 8 is an in-line heat treatment furnace one end of which is connected with the position of the bundling apparatus 7 and the other end of which extends in any chosen direction by any chosen length. Said heat treatment furnace 8 has a transfer conveyer 12 at its bottom for transporting, at a prescribed speed, and slow-cooling the steel wire coils 11 bundled and supported by the stems 9. Note that the interior of the heat treatment furnace 8 is transparently shown in the figure, different from the real appearance, for convenience sake. Also note that, after completing a slow cooling process and being discharged from the in-line heat treatment furnace 8, the steel wire coils alone are paid off at a proper position and the stems alone are transferred further to be charged again into the heat treatment furnace 8 through an end of the furnace for another bundling process, and this forms a circulating route. Note, further, that each of the water cooling zones 3*b* and 3*c* may consist of plural sections.

Figure 2:
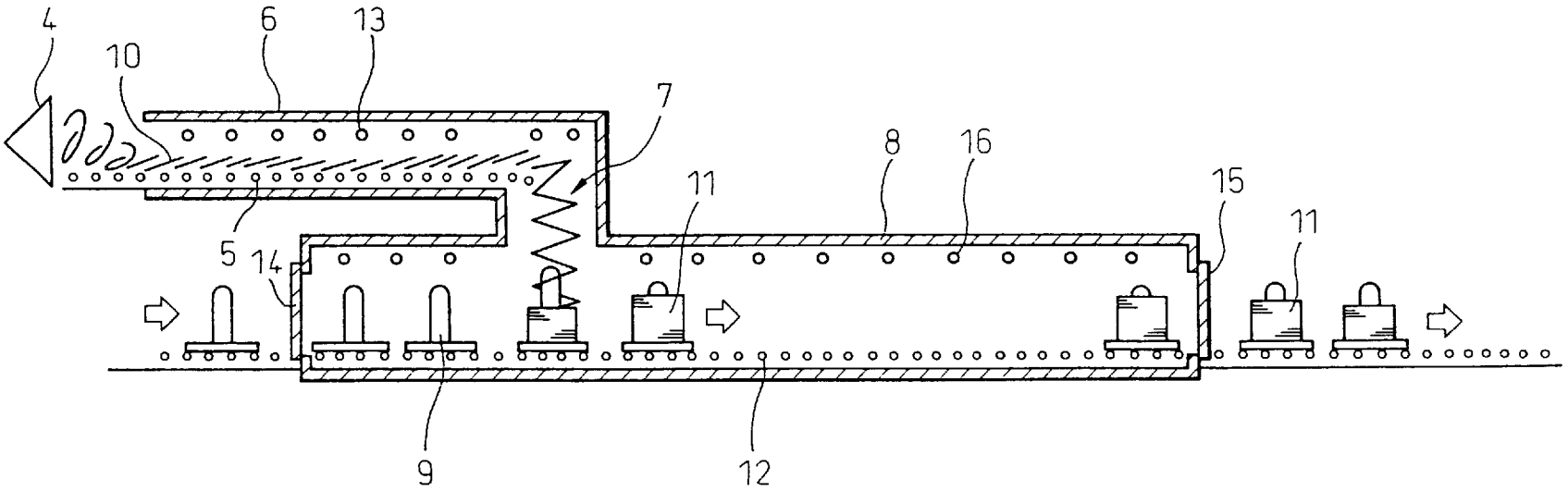
FIG. 2 is a sectional view showing each of the apparatuses at the rear of a winder in a train of equipment to continuously manufacture steel wire according to the present invention.

FIG. 2 is a sectional view showing a specific example of structures of the controlled cooling conveyer 5, the bundling apparatus 7 and the in-line heat treatment furnace 8, each installed at the rear of the winder 4. The controlled cooling conveyer 5 to transfer the steel wire in rings 10 is covered over all its circumference with a heat-insulating heat retention cover 6 to prevent a temperature drop, during the stages after the rolling to the bundling, for the purpose of obtaining the maximum effect of the controlled rolling and, at the same time, to make the conveyer function as a holding conveyer to allow the slow cooling process to start from a prescribed temperature not below $Ar_1$ transformation point. The heat retention cover 6 is equipped, preferably, with heating apparatuses 13 such as radiant tubes or heaters to heat its interior as required for preventing temperature drop. Note that the controlled cooling conveyer 5 must have a length to secure a required holding time and that, if the temperature holding is not necessary, it can be omitted and the steel wire may be packed into bundled coils immediately after being wound.

The bundling apparatus 7 provided at the rear end of the controlled cooling conveyer 5 is for receiving the wire rings falling from the conveyer in a manner that the stem 9 waiting underneath is inserted into the internal space of the rings to form a bundled coil of wire of a prescribed weight. It is desirable to form the bundled coils as tightly as possible to minimize temperature variance within a coil occurring during slow cooling. It is preferable to cover the bundling position, too, with heat-insulating walls continuously connected to the heat retention cover 6.

Further, the walls of the in-line heat treatment furnace 8 extending from the bundling position are also constructed of a continuous heat-insulating material. A door is provided at each end of said heat treatment furnace 8 (entry door 14 and exit door 15) for introducing the bundling stems 9 into the furnace and discharging them therefrom. Any suitable transfer means such as a roller conveyer or a chain conveyer maybe selected as the conveyer 12 to transport the stems inside the heat treatment furnace 8. Further, it is preferable to install radiant tubes or any other suitable heating apparatuses 16 inside the heat treatment furnace 8 to prevent a temperature drop when necessary and to secure slow cooling at a very mild cooling rate of 0.1° C./sec. or slower in the furnace.

Described hereafter are a preferable construction of the rolling mill, and preferable lengths of the water cooling and recuperation zones (especially the water cooling and recuperation zone at the entry side of the finishing block mill 2) and the in-line heat treatment furnace according to the present invention.

Figure 3:
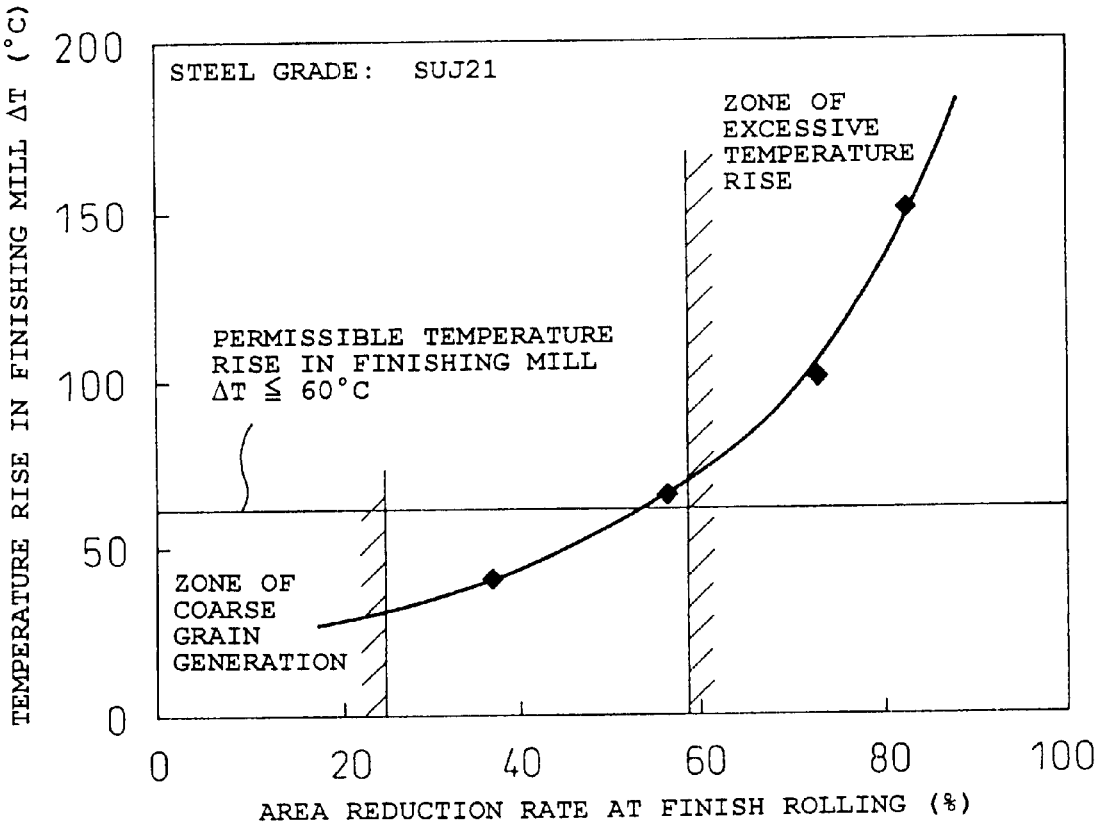
FIG. 3 is a graph showing the relationship between the area reduction rate and the temperature rise in a rolling mill in the case where a 4-roll stand block mill employed in the present invention is used.

The finishing block mill 2 consists of a block mill having at most 4 roll stands and its area reduction rate is in a range from 25 to 60%. FIG. 3 shows the relationship between the area reduction rate at finish rolling and the temperature rise in a finishing mill in the case of a 4-roll stand block mill. It can be understood from the figure that, assuming that an allowable temperature rise during finish rolling is 60° C., an appropriate range of area reduction rate is from 25 to 60%. The above figure for an allowable temperature rise was selected because the present inventors had confirmed, through studies, that the advantages of controlled rolling could be fully enjoyed when the material was cooled at a water cooling zone 3*b*, described hereafter, to a maximum extent but not to allow formation of an over-cooled structure and the temperature rise during finish rolling was controlled not to exceed 60° C.

That is to say, when the area reduction rate during finish rolling is below 25%, the strain imposed on the material is not enough to prevent uneven sectional strain distribution, which fact causes local growth of crystal grains and widely varied grain size, resulting in a phenomenon called coarse grains. This phenomenon markedly deteriorates cutting property and other aspects of workability. When the area reduction rate exceeds 60%, on the other hand, temperature rise is rapidly accelerated by the rolling work, hindering the desired controlled rolling. Considering the fact that the optimum average area reduction rate at each roll stand of a finishing block mill is roughly 15%, the number of roll stands of the block mill is preferably 2, 3 or 4. Any number of roll stands not exceeding 4 may be chosen depending on the size of the steel wire to roll and other conditions.

In view of the fact that the material temperature at the exit side of the pre-finishing block mill 1 rises to nearly 900° C., the water cooling zone 3*b* at the entry side of the finishing block mill 2 has a crucial function to maintain the material temperature at around 700° C., which is the entry temperature required for making the controlled rolling at the succeeding finishing block mill 2 effective. The zone between the mills including the water cooling zone 3*b* must have, besides the water cooling function, a recuperation function to homogenize the sectional temperature distribution created during the water cooling. It is important to specify the distance between the mills (denominated as d in FIG. 1) for fulfilling this function. Here, a very short time is enough for the water cooling, but the recuperation requires at least 0.1 sec. or so. Unless a time enough for the recuperation is secured, an excessive differential temperature will remain in the material section, resulting in an inhomogeneous material property created at the finish rolling.

Hence, for the water cooling and recuperation between the pre-finishing block mill 1 and the finishing block mill 2, said distance has to be at least 1/10 of the distance traveled at the maximum rolling speed (exit speed from the finishing block mill) or longer. For example, when the maximum rolling speed is 100 m/sec., water cooling and a recuperation zone of at least 10 m long has to be provided. In this case, since the speed at the entry of the finishing block mill is slower than the maximum rolling speed by a proportion corresponding to the area reduction rate of the finishing block mill, a little longer time than said 0.1 sec. necessary for the recuperation is secured and, hence, the water cooling process can be completed within the time thus secured. The longer said zone length is the more complete the recuperation will be, but this poses a problem that material threading into the mill becomes more difficult, besides making the total equipment length unnecessarily long. Thus an excessive length is undesirable and it is preferable to make the length equal to ½ of the maximum rolling speed or shorter. However the present invention is not intended to specify the upper limit length of this zone.

It is desirable also to specify the length of the in-line heat treatment furnace 8, in other words, resident time of the steel wire coils in said furnace, to make the slow cooling after the controlled rolling effective. Considering that it is necessary to cool an entire coil slowly through the transformation temperature range to obtain an intended soft steel wire, if the coil temperature at the entry of the heat treatment furnace is given, then the resident time can be defined under the restriction of a standard target slow cooling rate of 0.1° C./sec. or slower.

Figure 4:
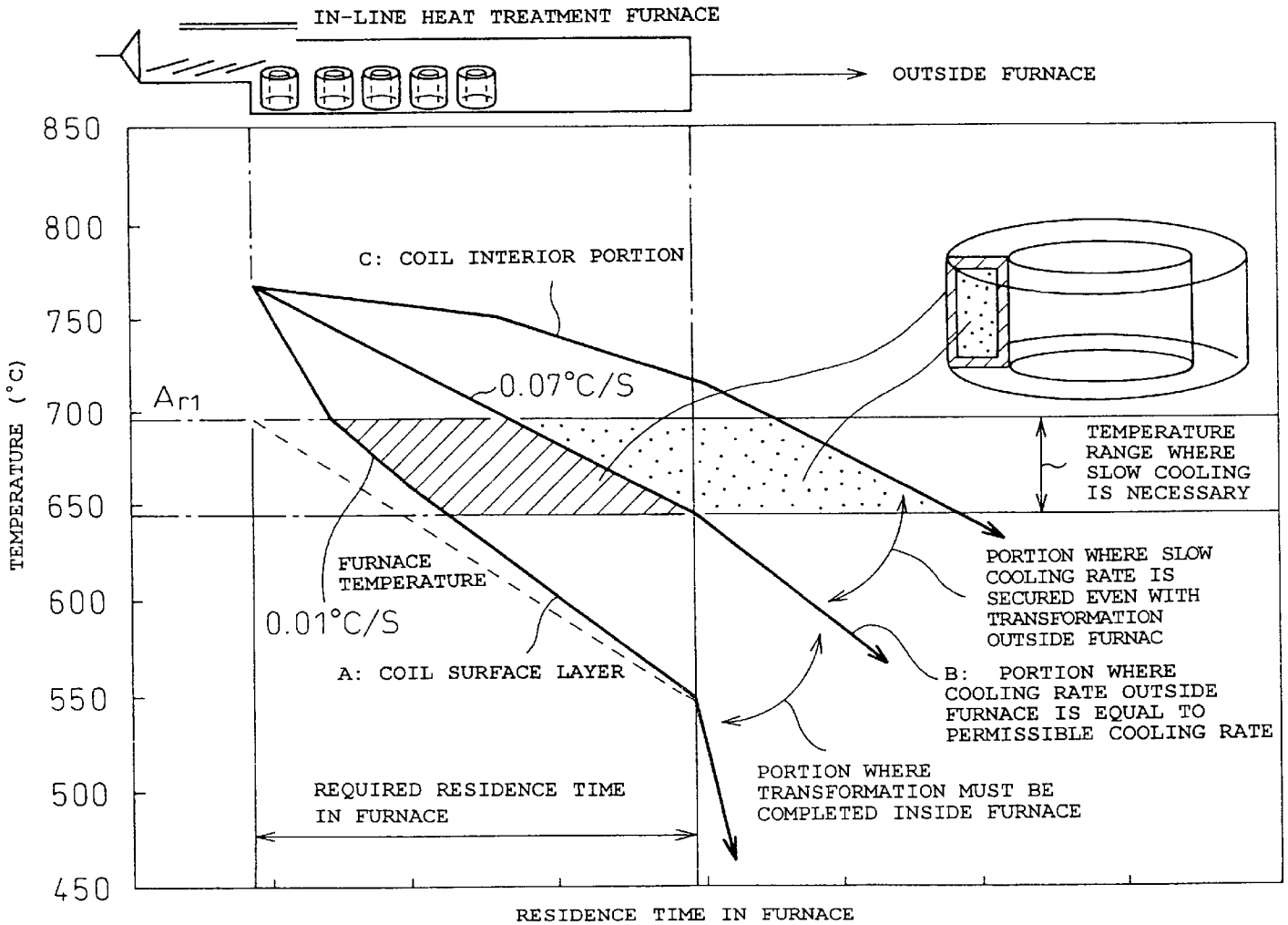
FIG. 4, is a graph showing the relationship between residence time in an in-line heat treatment furnace employed in the present invention and the temperature of a steel wire coil.

FIG. 4 shows the relationship between the furnace residence time of steel wire coils and the temperature. As schematically shown in the upper right part of the figure, a steel wire coil is divided into the coil surface layer (the hatched part in the sketched coil and the area between curves A and B) and the coil interior portion (the area between curves B and C). The coil surface layer is the portion that cools at a cooling rate exceeding the target slow cooling rate when left to cool naturally outside a furnace and, hence, has to be cooled in a heat treatment furnace to a temperature below the transformation temperature range. The coil interior portion, on the other hand, is the portion cooled at a cooling rate slower than the target cooling rate even when left to cool naturally outside a furnace and, hence, a sufficiently slow cooling rate is achieved even if it is discharged from a furnace before completion of transformation.

As a consequence, the present inventors discovered that, when a slow cooling operation proceeds under a furnace temperature set to cool the fastest cooled portion of the coil surface layer (A in FIG. 4) at the target cooling rate of 0.1° C./sec., the slowest cooled portion of the surface layer (B in FIG. 4) was cooled at a cooling rate of 0.07° C./sec., regardless of coil shape or wire diameter.

It takes at least 0.25 hrs. to slow-cool steel wire at a cooling rate of said 0.07° C./sec through a temperature range of roughly 60° C., namely the temperature range in which slow cooling is necessary, i.e., from a slow cooling commencement temperature just above the $Ar_1$ transformation point to a temperature below the temperature where the transformation completes. This is a lower limit indicator for defining the size of the heat treatment furnace. Taking temperature variance within a coil into account as an operational fluctuation factor here, the slow cooling commencement temperature has to be set a little higher than the point just above the $Ar_1$ transformation point and, hence, it is necessary to secure a furnace resident time of 0.5 hrs. or longer to obtain a stable product quality. It has to be noted, however, that the effect of slow cooling is saturated and no better result can be obtained if the resident time is prolonged to 1.0 hr. or longer: the furnace would simply be too long in such a case. As a conclusion, the heat treatment furnace must have a capacity to accommodate ¼ to all of the number of coils produced in 1 hr. at the maximum rolling capacity of the mill.

Manufacturing steps are sequentially described hereafter based on the-train of equipment to manufacture steel wire according to the present invention shown in FIG. 1. First, a billet of carbon steel or alloy steel is heated to 1,000° C. or above in a reheating furnace, not shown in the figure, then it is rolled into a prescribed size by a roughing mill train and an intermediate mill train, and the rolled material is fed to a pre-finishing block mill 1 via a water cooling zone 3*a*. The material rolled by the pre-finishing block mill 1 at an area reduction rate of at least 85% is water-cooled and recuperated at another water cooling zone 3*b*, enters a finishing block mill 2 to be finish-rolled to a final product diameter at an area reduction rate of 25 to 60%, comes out from the mill at a finishing temperature of 750 to 800° C. and, then, after passing through a third cooling zone 3*c*, is wound by a winder 4 into rings 10 of a prescribed diameter and laid onto a controlled/water cooling conveyer 5.

On the controlled cooling conveyer 5 covered with a heat retention cover 6, the steel wire in rings is transferred in the shape of non-concentric circles while maintaining a temperature not below the $Ar_1$ transformation point. Then, reaching the bundling apparatus 7, it is left to fall around a bundling stem 9 to form a tightly bundled coil 11 of a prescribed weight, and the coil is slow-cooled while being transferred at a constant speed in an in-line heat treatment furnace 8. The stems, each loaded with a bundled steel wire coil, are transferred in the furnace, in order, at fixed intervals. The coil temperature at the commencement of the slow cooling is roughly 710 to 780° C. The steel wire in a coil is slow-cooled inside the heat treatment furnace at a cooling rate of 0.1° C./sec., then discharged through the furnace exit door roughly at 650° C. to be left to cool naturally. The coiled wire completes the transformation during the natural cooling and is paid off for banding at a suitable position. Note that the steel wire may be heated inside the heat retention cover 6 and/or the heat treatment furnace 8, using heating apparatuses, when its temperature drops.

Next, the temperature controlling apparatuses according to the present invention are described in detail.

Figure 5:
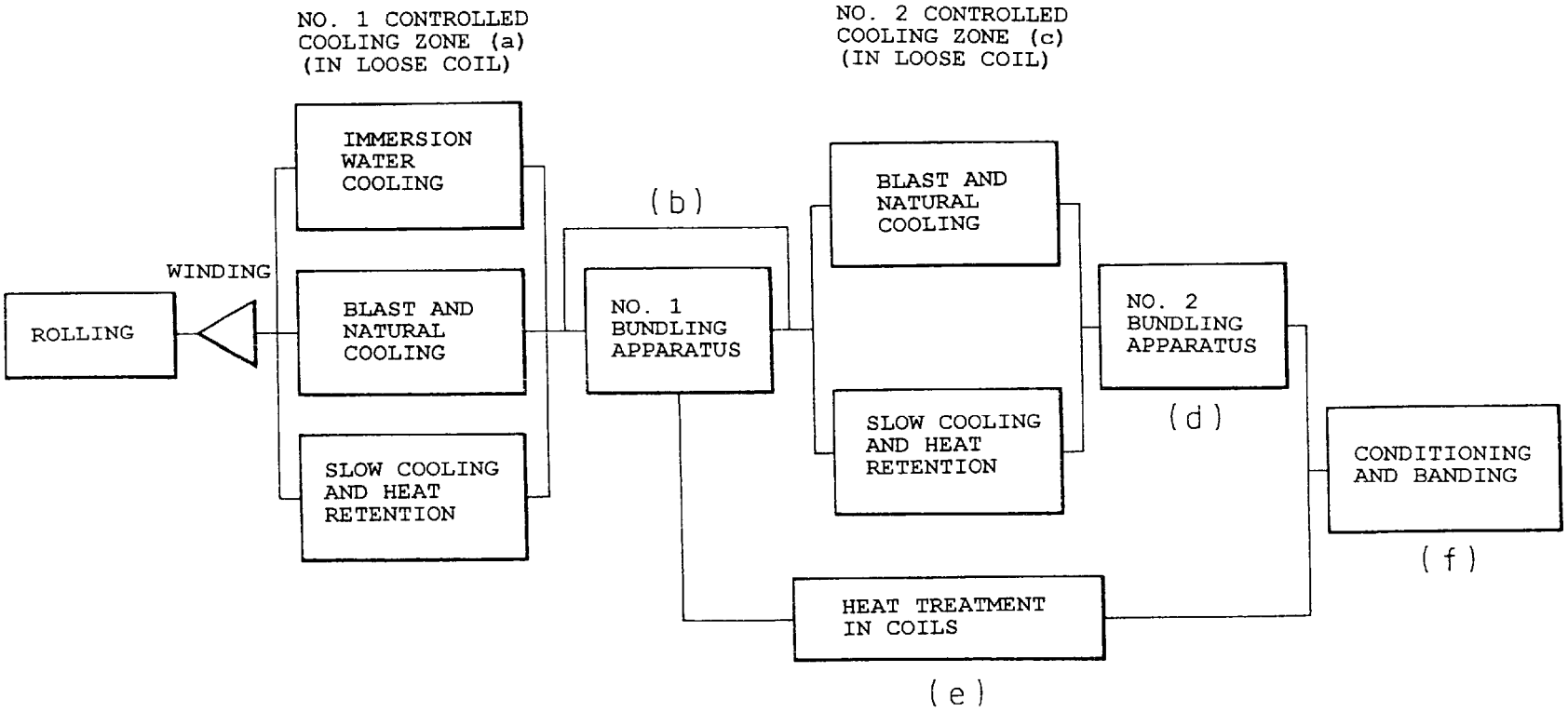
FIG. 5 is a block diagram of the case where a train of equipment composed of the temperature control apparatuses according to the present invention is incorporated in a steel wire manufacturing line.

FIG. 5 is a basic block diagram showing a series of manufacturing processes from rolling to conditioning and banding of the steel wire. The rolling equipment to heat the billets and hot roll them to a prescribed diameter and the winder to wind the rolled wire with allaying head into rings have already been described above. The temperature controlling apparatuses according to the present invention comprise, further:

(a) No. 1 controlled cooling zone immediately following the winder, easily and selectively convertible into any of a water cooling line, a blast/natural cooling line and a slow cooling and heat retention line (for loose coils);

(b) a transfer means to transfer the rings from said No. 1 controlled cooling zone (a) to No. 2 controlled cooling zone (c) to be described below, and No. 1 bundling means to pack the steel wire rings into bundled coils, both installed at the boundary between (a) and (c) in a manner that they are used alternatively;

(c) No. 2 controlled cooling zone, easily and selectively convertible into any of a blast and natural cooling line and a slow cooling and heat retention line, installed succeeding No. 1 controlled cooling zone (for loose coils);

(d) No. 2 bundling means provided at the rear end of No. 2 controlled cooling zone;

(e) a heat treatment means, connected with No. 1 bundling means, to slow-cool or heat the bundled coils formed there (for bundled coils); and (f) a conditioning and banding means serving both No. 2 bundling means and the heat treatment means.

Figure 6:
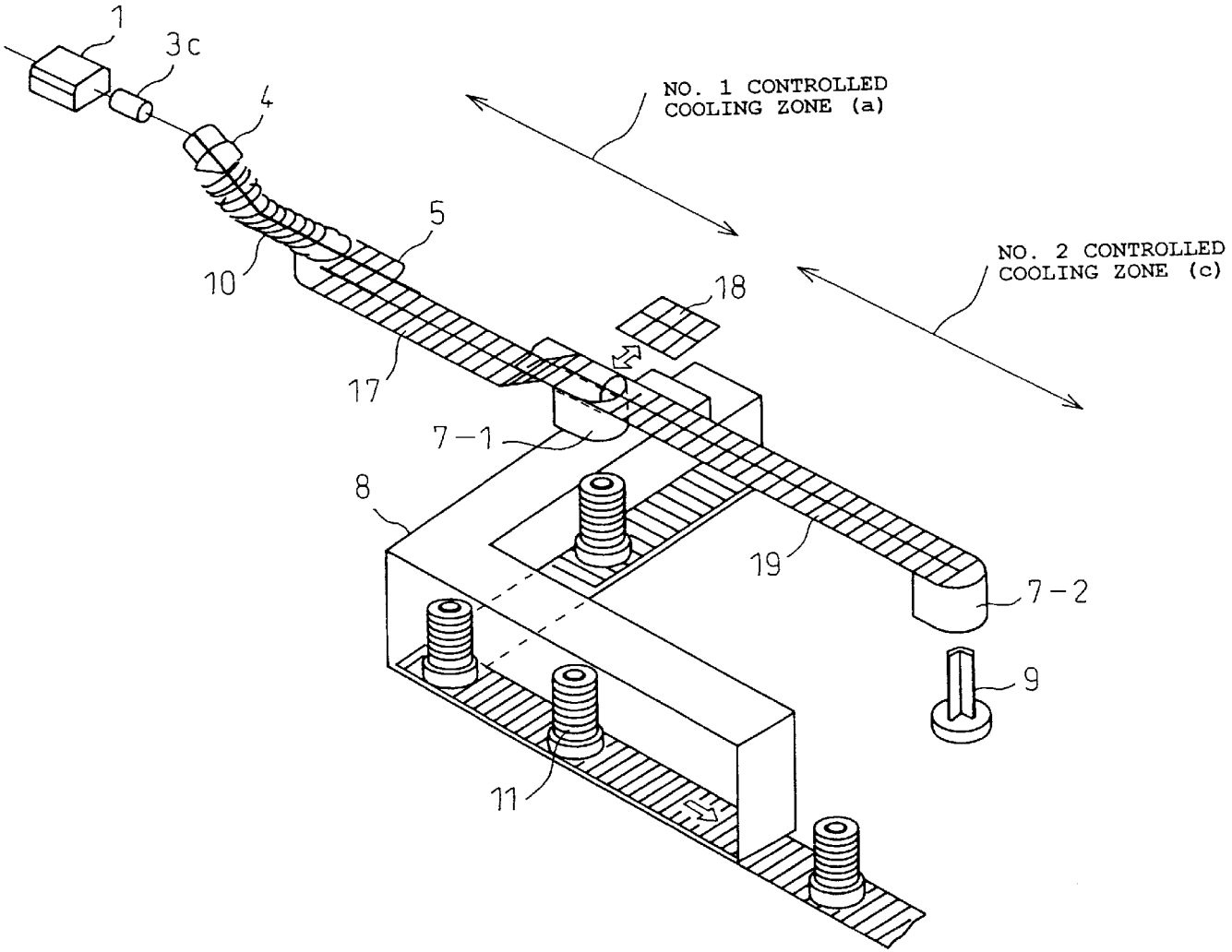
FIG. 6 is a general schematic view of an embodiment of the temperature control apparatuses for steel wire according to the present invention showing the case where heat retention covers are removed.
Figure 7:
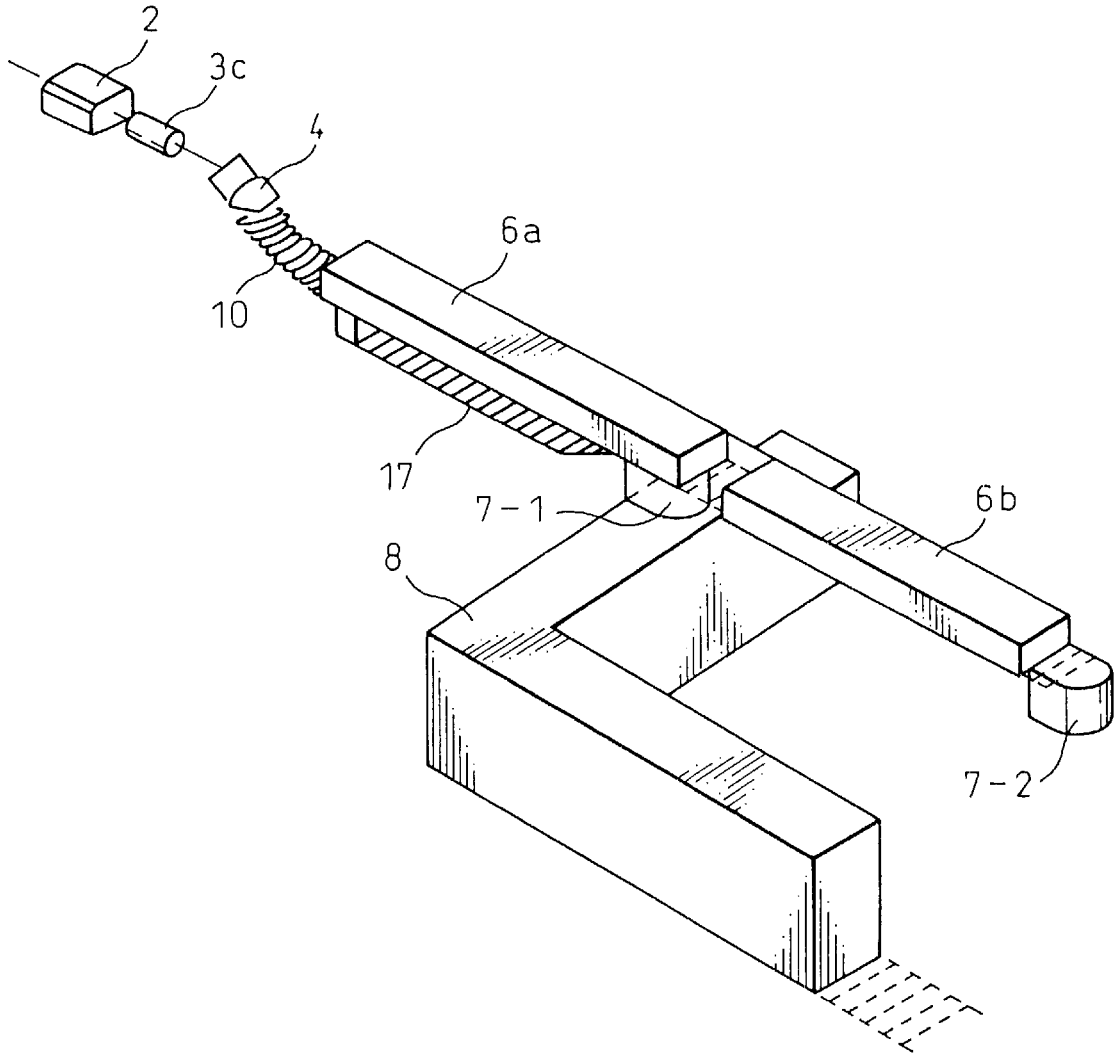
FIG. 7 is a schematic view showing the embodiment shown in FIG. 7 in the case where the heat retention covers are in place.
Figure 8A:
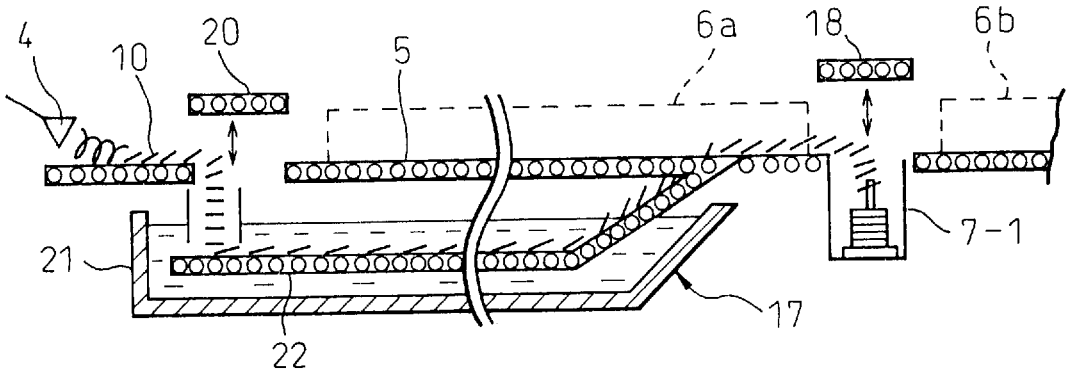
FIG. 8 is explanatory side views showing embodiments of No. 1 controlled cooling zone, which is a component of the equipment of the present invention.
Figure 8B:
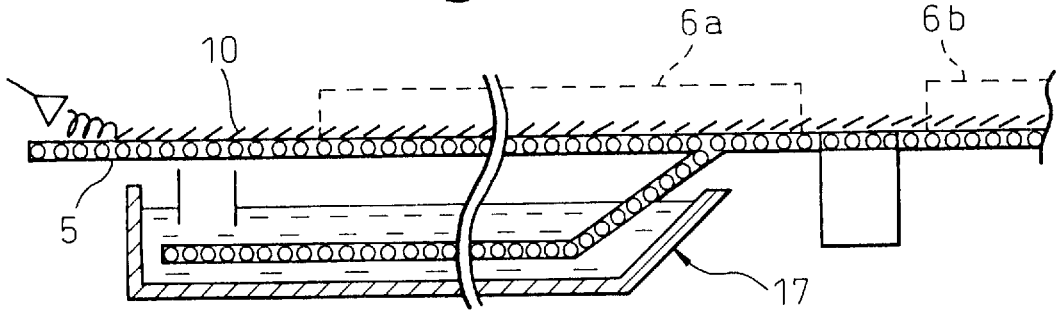

FIG. 6 is a general schematic view specifically showing main parts of the process equipment shown in FIG. 1, wherein the heat retention covers of the conveyer lines after the winder are omitted and the in-line heat treatment furnace is shown transparently for convenience sake. FIG. 7 is, contrarily, a schematic view showing the heat retention covers and the heat treatment furnace as installed, and FIG. 8 is explanatory sectional side views of No. 1 controlled cooling zone after the winder and No. 1 bundling means.

In FIG. 6, the following reference numerals indicate the following apparatuses, respectively: 2 a high rigidity finishing block mill to reduce the sectional area of steel wire to a final diameter; 3*c* a water cooling zone provided at the exit side of the block mill 2; 4 a winder; 5 a blast and natural cooling conveyer to transfer steel wire 10 wound and spread in non-concentric rings by the winder 4; 17 an immersion cooling apparatus beneath the former part of said blast and natural cooling conveyer 5, virtually in parallel to the conveyer; 7-1 No. 1 bundling apparatus at the middle of the blast and natural cooling conveyer 5; 7-2 No. 2 bundling apparatus at the rear end of the blast and natural cooling conveyer 5; 18 a line switching conveyer at the position of No. 1 bundling apparatus 7-1 in a manner to allow switching to and from said No. 1 bundling apparatus 7-1; 8 a tunnel type in-line heat treatment furnace extending from the position of No. 1 bundling apparatus 7-1; 9 a bundling stem to be fed to the bundling apparatuses for receiving the wire rings; and 11 a bundled coil of steel wire being transferred in the in-line heat treatment furnace 8 by a transfer means such as a conveyer, after being bundled around a bundling stem 9.

It has to be noted that the blast and natural cooling conveyer 5 is installed from a position below the winder 4 to the position of No. 2 bundling apparatus 7-2 via No. 1 bundling apparatus 7-1 and the line switching conveyer 18. Note also that the former part and the latter part of the blast and natural cooling conveyer 5, divided at the position of No. 1 bundling apparatus 7-1, are covered over all their circumferences with respective heat retention covers 6*a* and 6*b* as shown in FIG. 7. Said heat retention covers 6*a* and 6*b* are made of a heat insulation material and heat sources such as radiant tubes or heaters are provided inside them to heat their interiors as required for slow-cooling or heat retention of the steel wire in rings. Besides, a blast means not shown in the figure is provided somewhere beneath the blast and natural cooling conveyer 5 for cooling the wire rings with an air blast.

In the present invention, the former part of the blast and natural cooling conveyer 5, from immediately after the winder to No. 1 bundling means, covered with a heat retention cover, and the immersion cooling apparatus 17 provided beneath it are collectively called No. 1 controlled cooling zone, and the latter part 19 of the blast and natural cooling conveyer 5, from immediately after No. 1 bundling means to No. 2 bundling means, covered with a heat retention cover, is called No. 2 controlled cooling zone (see FIGS. 6 and 7).

Next, examples of switching selection of various cooling and/or heat retention modes at No. 1 controlled cooling zone are described based on FIG. 8. Firstly, FIG. 8 (*a*) shows a case where the steel wire in rings 10 supplied from the winder 4 is led downward to the immersion cooling apparatus 17 for a rapid cooling, is packed into bundled coils at No. 1 bundling apparatus 7-1, and is fed to the heat treatment furnace 8 for a suitable heat treatment. In this case, line switching conveyers at the entry side of the blast and natural cooling conveyer 5 and at the position of No. 1 bundling apparatus 7-1 are moved beforehand to their respective retracted positions (although FIG. 6 shows only one switching conveyer 18 at the position of No. 1 bundling apparatus 7-1, actually there is a similar switching conveyer 20 also at the entry side of the blast and natural cooling conveyer 5). Any retraction method such as a vertical movement, as shown in the figure, a lateral movement or a swiveling movement is acceptable. The steel wire in rings 10 laid by the winder 4 is immediately immersed in an immersion tank 21 of the immersion cooling apparatus 17, transferred by a conveyer 22 in the tank, raised to the level of the blast and natural cooling conveyer 5, then falls around the bundling stem 9 at No. 1 bundling apparatus 7-1 to form a coil of a prescribed weight. In the line shown in FIG. 8 (*a*), a possible heat treatment is, for example, that the wire in rings 10 is quenched through rapid cooling in the immersion cooling apparatus 17 and then tempered in the heat treatment furnace 8 in the form of a coil. Either cold water or hot water may be used for the water cooling, allowing a choice in accordance with the steel grade and the required treatment pattern.

On the other hand, FIG. 8 (*b*) shows a case where the switching conveyers 20 and 18 are set beforehand at the level of the blast and natural cooling conveyer 5 in order to transfer the wire in rings 10 directly to No. 2 bundling apparatus 7-2 for bundling into coils. In this case, the wire in rings 10, while being transferred on the conveyer 5, may be left to cool naturally, blast-cooled by blowing a chosen fluid onto the rings or, otherwise, slow-cooled or heat-retained by the heat retention covers 6*a* and 6*b*. Note that the heat retention covers may be constructed so as to be capable of opening and closing. In FIG. 8 (*b*), it is also possible to pack the steel wire into bundled coils at No. 1 bundling apparatus 7-1 by retracting the switching conveyer 18 from the line, and feed the coils to the in-line heat treatment furnace 8 for slow cooling or heating. It is possible to produce steel wire having an excellent cold working property by, for example, slow-cooling the steel wire in the heat retention cover 6*a* by preventing it from cooling to below $Ar_1$ transformation point, bundling it into coils at No. 1 bundling apparatus 7-1 and slow cooling the coils at a cooling rate of 0.1° C./sec. or slower in the in-line heat treatment furnace 8. In this, case it is necessary that the steel material is finish-rolled by the finishing block mill 2 before the winder 4 at as low a temperature as possible. A desirable manufacturing apparatus of hot rolled steel wire is provided by combining the finishing block mill 2 with the temperature controlling apparatuses according to the present invention.

Figure 9:
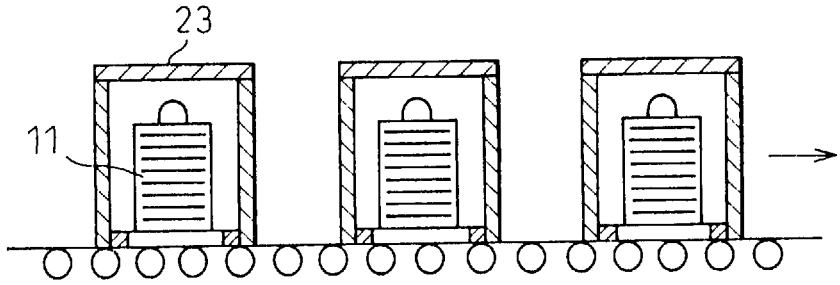
FIG. 9 is an explanatory view showing an example of pot type heat treatment furnaces employed in the present invention.

Note that independent pot type furnaces 23 to cover the bundled steel wire coils 11 individually as shown in FIG. 9 may be used for slow-cooling or heating the coils in place of a tunnel type continuous furnace such as the in-line heat treatment furnace 8 shown in FIGS. 6 and 7. The pot furnaces 23, each of which may be provided with internal heat sources, will be transported on a conveyer at a prescribed speed and at constant intervals.

INDUSTRIAL APPLICABILITY

Effects obtainable by the use of the train of equipment to manufacture steel wire according to the present invention described above are as follows:

(1) The present invention has achieved, for the first time, a rational coupling of an apparatus for the controlled rolling by a block mill with apparatuses for in-line slow cooling of steel wire packed into bundled coils, which has hitherto been considered difficult.

(2) The coupling of the controlled rolling with slow cooling has made possible on-line manufacturing of steel wire for machine structure use having an excellent cold working property, without requiring any off-line heat treatments.

(3) The present invention reduces equipment costs, since its application does not require a significant modification of an existing steel wire manufacturing line, and allows the omission of off-line annealing equipment.

(4). When a controlled cooling and transfer apparatus is provided after a winder, the apparatus stably retains the heat of steel wire wound into rings, feeding the steel wire always in the best condition to a succeeding bundling apparatus and a slow cooling line.

(5) Installation of a water cooling and recuperation zone having a prescribed length at the entry side of a final finishing block mill allows control of the temperature and properties of the steel material fed to the block mill and the controlled rolling to be performed in better conditions.

(6) The present invention markedly expands the degree of freedom regarding the means for in-line treatment of hot rolled steel wire, making it possible to perform various kinds of heat treatment (heating, holding, slow cooling, etc.) on-line, which have conventionally been performed off-line.

(7) No. 1 bundling means, installed in a selectable manner, and an in-line heat treatment means of coils connected therewith, both provided at the rear end of No. 1 controlled cooling zone, make it possible to process steel wire in coils at a slow travelling speed, realizing a protracted heat treatment impracticable with a No. 2 controlled cooling zone.

(8) Since apparatuses for controlled cooling of steel wire in rings can be arranged vertically, the equipment is compact and advantageous in terms of operability.

(9) Application of the equipment configuration according to the present invention brings about an efficient arrangement of the processes from rolling to conditioning and banding of steel wire. The present invention is advantageous also in terms of costs since its application requires no significant modification of an existing wire manufacturing line.

What is claimed is:

1. A train of equipment to continuously manufacture steel wire comprising continuously connecting:

a finish hot rolling block mill having an entry side and an exit side for providing hot rolled steel wire and comprising at most four roll stands;

a water cooling and recuperation equipment located at the entry side of the finish hot rolling block mill;

a winder located at the exit side of said finish hot rolling block mill for winding said hot rolled steel wire into rings;

a controlled cooling apparatus comprising a first controlled cooling apparatus located after said winder for receiving said wire rings and having means for selectively converting into one of a water cooling device, a blast cooling device, and a slow cooling device having a cooling rate of 0.1° C./second or less;

at least one bundling apparatus located after said controlled cooling apparatus for packing said wire rings into bundled coils;

an in-line tunnel heat treatment furnace located after said at least one bundling apparatus for receiving said bundled coils from said at least one bundling apparatus, said in-line tunnel heat treatment furnace having a capacity to accommodate ¼ to all of a number of said bundled coils produced in 1 hour at an actual rolling capacity of said finish hot rolling block mill.

2. A train of equipment to continuously manufacture steel wire according to claim 1, wherein said controlled cooling apparatus further comprises:

said slow cooling device provided with heat retention equipment, and a second controlled cooling apparatus located after said first controlled cooling apparatus, said second controlled cooling apparatus having means for selectively converting into one of a blast cooling device and a slow cooling device having a cooling rate of 0.1° C./second or less, said slow cooling device of said second controlled cooling apparatus provided with heat retention equipment.

* * * * *